US006210016B1

(12) United States Patent
Prineppi

(10) Patent No.: US 6,210,016 B1
(45) Date of Patent: Apr. 3, 2001

(54) CHRISTMAS TREE LIGHTING

(76) Inventor: Frank J Prineppi, 1323 SE. 17th St. Suite 341, Ft. Lauderdale, FL (US) 33316

( * ) Notice: Subject to any disclaimer, the term of this patent is extended or adjusted under 35 U.S.C. 154(b) by 0 days.

(21) Appl. No.: 08/816,960

(22) Filed: Jan. 27, 1997

(51) Int. Cl.[7] ..... F21P 1/02

(52) U.S. Cl. ..... 362/123; 362/233; 362/250; 362/252

(58) Field of Search ..... 362/123, 233, 362/234, 238, 239, 249, 250, 252, 253, 288, 391, 428, 806

(56) References Cited

U.S. PATENT DOCUMENTS

| | | | | |
|---|---|---|---|---|
| 3,569,691 | * | 3/1971 | Tracy | 362/233 |
| 3,714,414 | * | 1/1973 | Sternius | 362/249 |
| 4,404,621 | * | 9/1983 | Mauro | 362/249 |
| 4,462,065 | * | 7/1984 | Rhodes | 362/252 |
| 4,521,839 | * | 6/1985 | Cook et al. | 362/238 |
| 4,870,574 | * | 9/1989 | Crucefix | 362/123 |
| 4,885,664 | * | 12/1989 | Hermanson | 362/123 |
| 5,309,334 | * | 5/1994 | Willison | 362/252 |
| 5,510,966 | * | 4/1996 | Konecny | 362/249 |
| 5,609,412 | * | 3/1997 | Contigiani | 362/249 |
| 5,700,081 | * | 12/1997 | Mengle et al. | 362/123 |

* cited by examiner

*Primary Examiner*—Alan Cariaso

(57) ABSTRACT

In a decorative light string for Christmas trees the improvement comprising a plurality of light socket support members in the form of wands at spaced intervals along the string, each being adapted to support selected groups of light sockets and being insertable into the interior of a Christmas tree at spaced intervals. With this arrangement, the light string illuminates the interior of the Christmas tree via the light bulbs and light sockets supported on the wands, and illuminates the exterior of the Christmas tree via the remaining sockets and light bulbs on the light string. This allows the interior of the Christmas tree to be decorated and therefore illuminated by simple insertion of the wands at selected intervals around the Christmas tree.

3 Claims, 4 Drawing Sheets

CHRISTMAS TREE LIGHTING

BACKGROUND OF THE INVENTION

This invention relates to decorative lighting for Christmas trees, in particular to decorative lighting adapted to illuminate the external surfaces of a tree and the interior.

A tree which is only illuminated on the external surface looks relatively plain when compared to a tree which also includes interior lighting. However, to achieve the latter with a conventional string of Christmas tree fairy lights the decorator must thread the light string and attendant light sockets and light bulbs throughout the tree, along branches and around the trunk, as well as ensuring that the outer surface of the tree is also adequately illuminated. This is tedious, time consuming and may result in the arms and hands of the decorator being scratched or abraded. These disadvantages also occur when the light string is removed after Christmas or when a light bulb has to be replaced. For these reasons, the lighting of the inside of a Christmas tree is often dispensed with, even though it is the preferred choice for many.

Alternative methods of illuminating the inside of Christmas trees are known but these tend to be complicated or expensive and still do not obviate all or many of the disadvantages described above, particularly where the lighting is to be used on a real Christmas tree as opposed to an artificial one. It is therefore an object of the present invention to provide an uncomplicated and inexpensive means of illuminating the exterior and interior of a Christmas tree in which the aforementioned disadvantages are obviated.

SUMMARY OF THE INVENTION

According to the invention there is provided an electrically operable decorative light string including a plug connected to one end thereof for insertion into a household socket to provide electrical power therefor, the light string including a plurality of light sockets and associated light bulbs, and a plurality of light socket support members in the form of wands (as hereafter defined) at spaced intervals along the string, each adapted to support selected groups of said light sockets and being insertable into the interior of a Christmas tree at said spaced intervals such that, in use, the light string illuminates the interior of the Christmas tree via said selected ones of said light bulbs and light sockets supported on said plurality of said wands, and illuminates the exterior of the Christmas tree with the remaining light sockets and light bulbs on the string.

The wands may typically each comprise a rod of generally transparent plastics material which includes along the length thereof a series of light socket holders with sockets and light bulbs. With this arrangement, the light string may be wound around a Christmas tree from bottom to top in a conventional manner and at spaced intervals the wands can then be easily inserted into the interior of the tree without the need for the decorator to expose arms or hands to possible injury. There is also no need to thread the entire string throughout the interior and exterior of the tree in order to provide complete illumination and hence the previously tedious and time consuming method of achieving the same objective is obviated. Similarly, when the festive season is over the light string can be easily removed by simply plucking out the wands as the light string is wound off the tree. Also, because each wand supports a number of lights, typically five to eight, they collectively serves as a wire-tidy which therefore minimises the possibility of the light string becoming knotted; and this also permits the light string to be easily rolled up when not in use.

The wands may each conveniently include means to obtains access to individual light bulbs for easy replacement thereof in the event of failure, such as by incorporating exposed areas around each individual light socket holder along the length of each wand which allow the fingers of a hand to remove and replace faulty light bulbs. Alternatively, each light socket holder may permit its respective light socket to be bent or swivelled outwards for access in order to facilitate light bulb replacement.

As well as being rod-shaped the wands may be of varying shapes including circular or oval, since their primary function is to serve as a guide for fairy lights in the string which are intended to illuminate the interior of the tree, so that the lights are supported therewithin and require no further attention once inserted in the desired position. Tie points may, however, be provided for additional security which could be used to secure the support members in place at conveniently exposed portions of branches etc. by means of wire clips or some other form of releasable fastener.

Although the wands must necessarily be sufficiently rigid to support lights thereon, they may nevertheless be made of a semi-rigid bendable material such that each may be individually pre-bent prior to or even after insertion into the tree so as to maximise their spatial position therewithin.

The wands may also be composed of individual elements which releasably interconnect with each other, each including a light socket holder. With this arrangement, the light string may be adapted to suit particular requirements, such as by making the initial wands in the string relatively longer than those towards the end of the string to correspond with the progressively shorter radius of the cone-shaped tree from bottom to top. Alternatively, the length of the wands may be pre-set so that they become progressively shorter, and hence carry fewer light sockets and light bulbs towards the end of the light string remote from the electric plug.

In an alternative embodiment of the invention, the light sockets and their respective light bulbs are moveable from a closed position in which they lie generally flat against or along each wand to a position in which each light bulb is swivelled or otherwise moved outwardly away from the major axis of the wand so that it becomes fully exposed when in use. This may be achieved by mounting each of the light socket holders on a respective pivot so that after insertion of the closed wand into the tree each light bulb may be individually moved into a generally upright position.

Alternatively, this may be achieved semi-automatically by providing a sliding mechanism of length generally corresponding to the length of each wand, having projections co-operable with each light socket so that the light sockets and thus light bulbs may be collectively either raised or lowered. With this arrangement the wand may be inserted into the tree with the light sockets and their respective light bulbs laid flat thereagainst and once in position the light bulbs can then be raised to their operating position in which they are fully visible.

BRIEF DESCRIPTION OF THE DRAWINGS

The invention will now be described, by way of example only, with reference to the accompanying drawings in which.

DETAILED DESCRIPTION OF THE DRAWINGS

Figure 1:
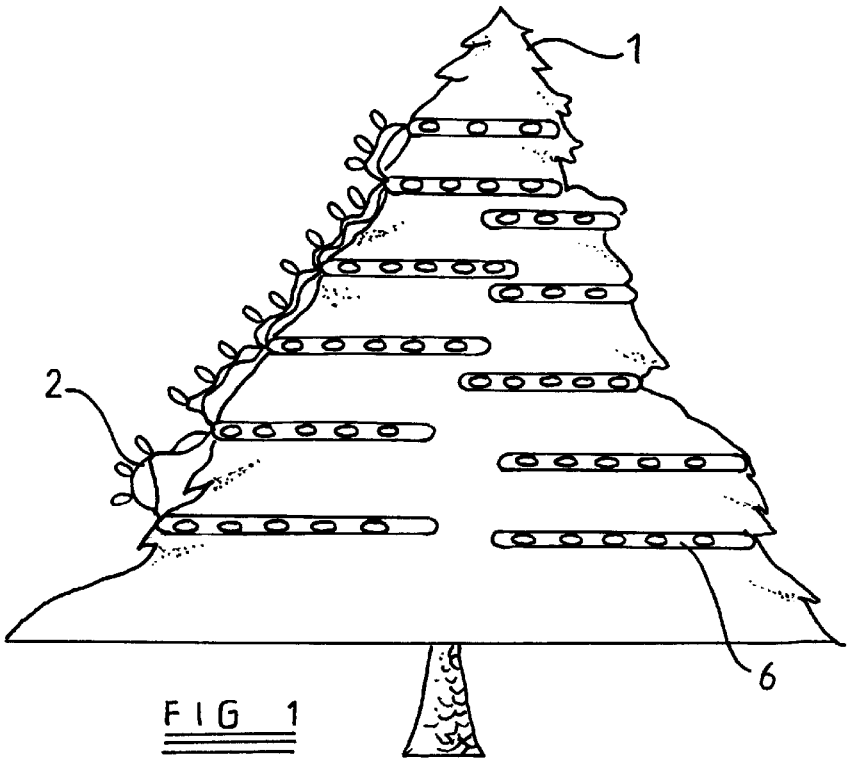
FIG. 1 is a schematic view of the light string according to the invention in place on and within a Christmas tree.
Figure 2:
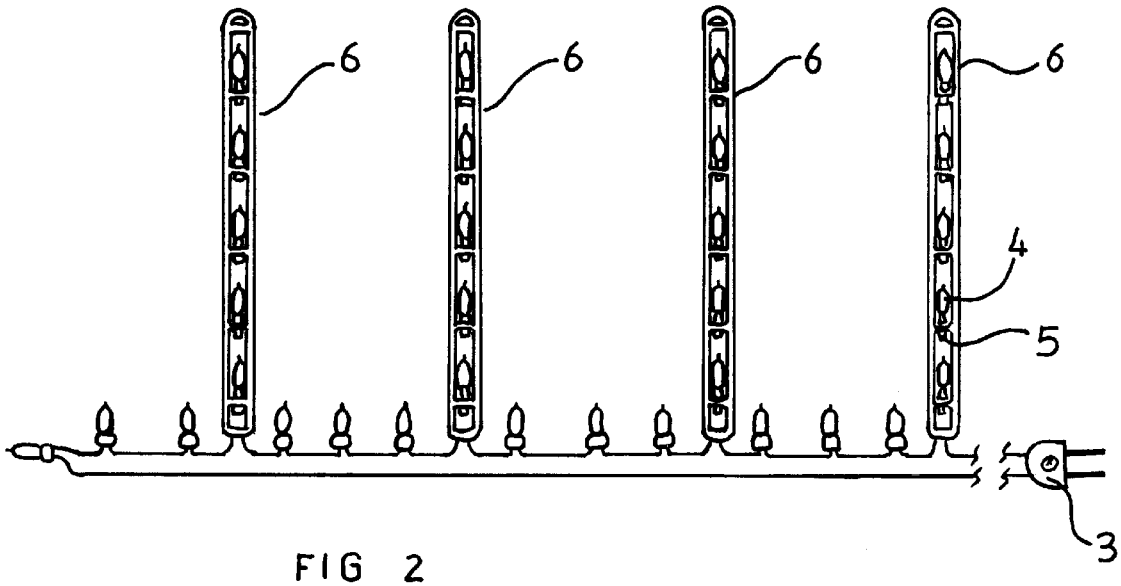
FIG. 2 is a schematic view of a representative portion of the light string shown in FIG. 1 laid out flat.

Referring to FIG. 1 there is shown a schematic view of a conventional Christmas tree 1 onto and into which has been mounted a light string 2 according to the invention by means of which the exterior and the interior of the tree may be illuminated. The light string 2 includes a conventional household plug 3 at one end thereof, a series connected set of conventional light bulbs and light bulb holders 4, 5, selected groups of which are mounted for support on light socket support members in the form of rigid plastics rod-shaped wands 6 at spaced intervals along the light string 2. With this arrangement the tree 1 may be decorated on the inside and the outside by simply winding the light string around the tree in the conventional manner and at the intervals dictated by the distance between each successive wand 6, inserting them radially into the tree 1 where they are supported on branches and thereby maintain the desired position.

Figure 3:
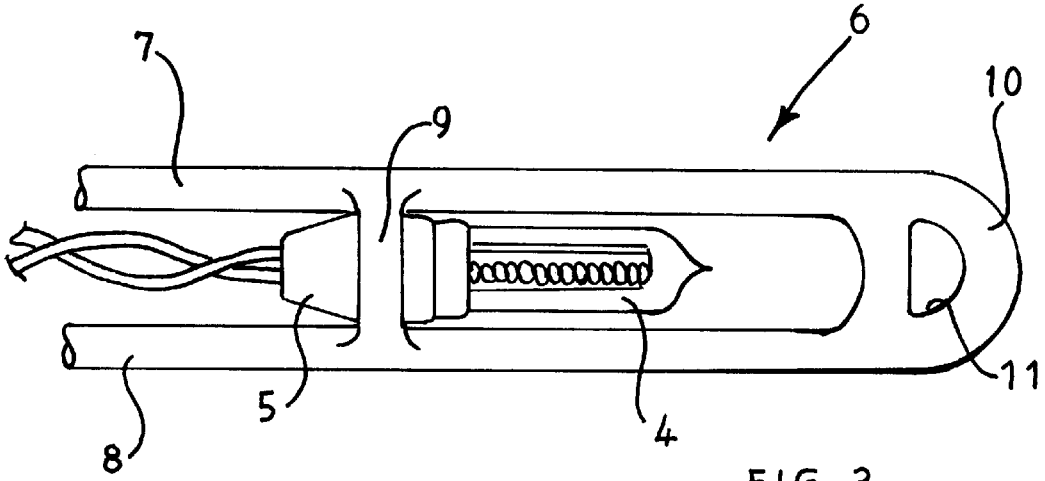
FIG. 3 is a detailed view of an end portion of a wand of the type used in the light string shown in FIGS. 1 and 2.
Figure 4:
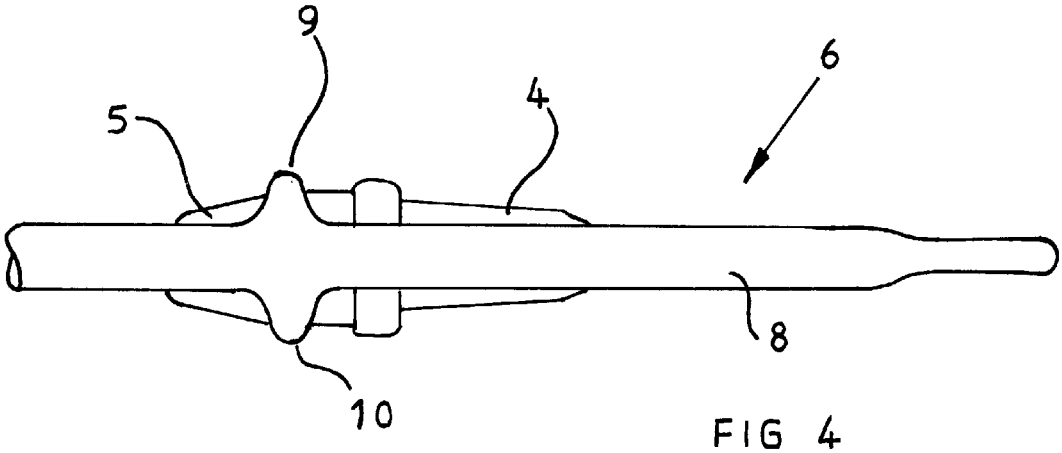
FIG. 4 is a side view of the portion of the wand shwon in FIG. 3.

In FIGS. 3 and 4 there is shown a detailed view of the free end of the wand 6 in which it will be seen that it is comprised of a pair of elongate rods 7, 8 interconnected at spaced intervals along its length by part-circular links 9, 10, respective pairs of which also serve the function of acting as holders for respective light sockets 5 and attendant bulbs 4. At the free end of the wand 6 the rods 7, 8 are moulded together in a generally "D" shape 10, defining an aperture 11 by which the wand 6 may, if preferred, be tied or otherwise secured to the interior of the tree by a releasable fastener (not shown).

Figure 5:
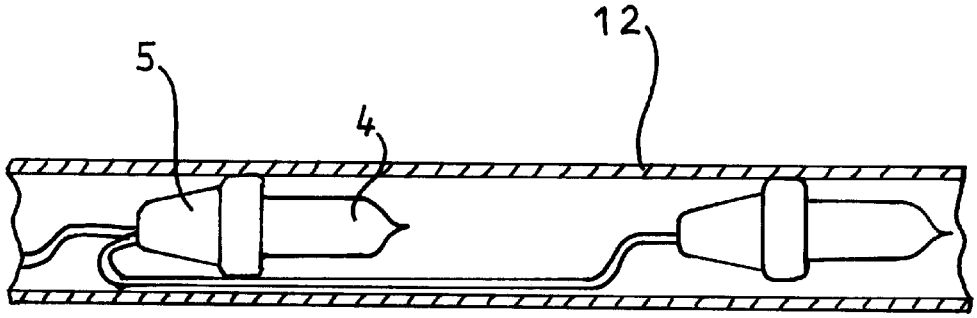
FIG. 5 is a view of an end of a wand corresponding to that shown in FIG. 3 but in which the wand itself is comprised of a clear plastics tube within which are axially disposed individual light sockets and their respective light bulbs.

In FIG. 5 there is shown an alternative embodiment of wand to that shown in FIGS. 3 and 4 which comprises a transparent plastics tube 12 within which are axially positioned light bulbs 4 and light sockets 5. In this embodiment they are supported by the interior of the tube 12 which is of size generally corresponding to the external radius of each light socket 5.

Figure 6:
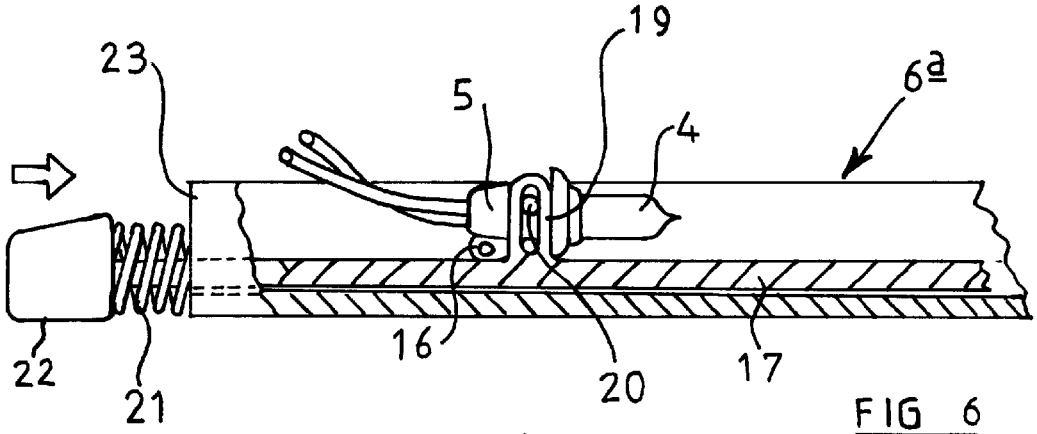
FIG. 6 is a part sectional view of an alternative embodiment of the invention wherein each light socket and respective light bulb of each wand may be selectively swivelled outwardly to expose each bulb.
Figure 7:
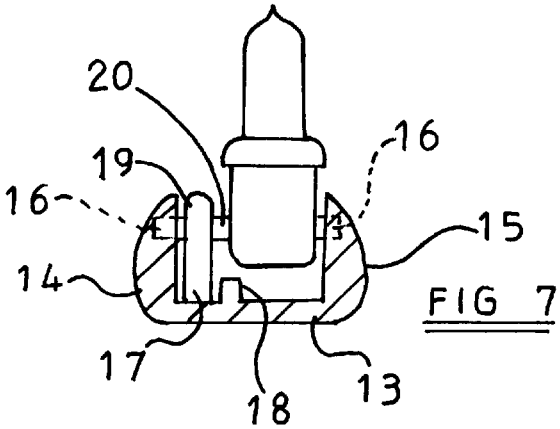
FIG. 7 is a part-sectional view of the wand of FIG. 6.
Figure 8:
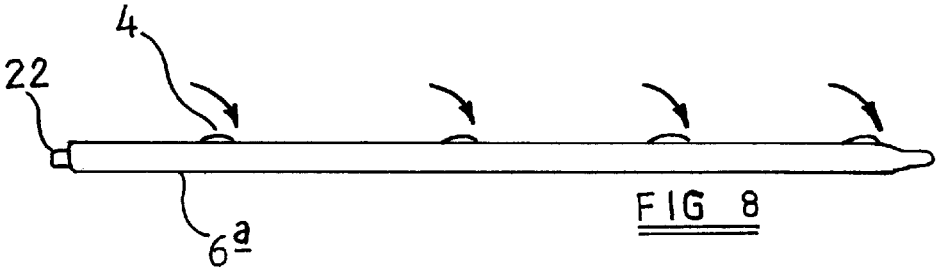
FIG. 8 is a schematic view of the wand shown in FIGS. 6 and 7 in which the light bulbs are shown in their stored position.
Figure 9:
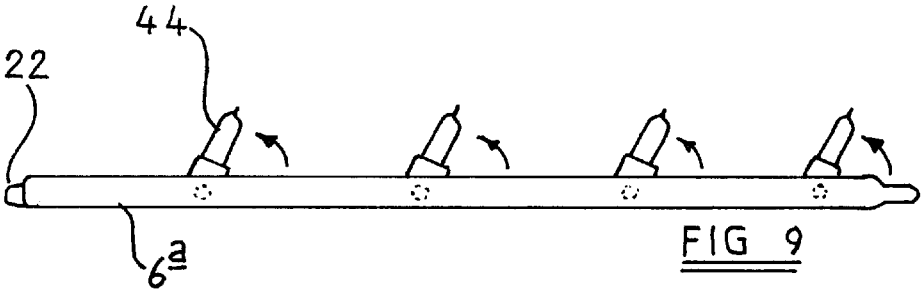
FIG. 9 is a view corresponding to that of FIG. 8 but in which the light bulbs are shown in their exposed position.

Turning now to FIGS. 6 and 7 there is shown in each a part sectional view of part of a wand 6*a* which is adapted to selectively permit each light socket 5 and respective light bulb 4 to be swivelled outwards from a stored position as shown in FIG. 8 to an exposed position as shown in FIG. 9. In this embodiment the wand comprises a generally flattened strip 13 moulded contiguously with semicircular side walls 14, 15 which collectively define a channel for receiving respective groups of light bulbs 4 and light sockets 5.

The sockets 5 are each provided with integral pivot pins 16 which project outwardly from respective sides thereof and are received within corresponding bores on opposing internal faces of the side walls 14, 15 so that each light bulb 4 and light socket 5 can be swivelled outwardly to the position shown in FIG. 9 or swivelled back to the position shown in FIG. 8 in which they lie within the channel defined by the side walls 14, 15 and the strip 13. Although this may be achieved individually, the embodiment of the wand 6*a* shown in FIGS. 6 and 7 incorporates a semi-automatic mechanism by which the light bulbs 4 are normally biased to the position shown in FIG. 9 but may be selectively stored away in the position shown in FIG. 8 in order to allow for easy insertion or removal of the wand 6*a* into or from a Christmas tree. This is achieved by means of a spring-loaded slide rod 17 which is guided for lengthwise sliding movement between side wall 14 and a projection 18 extending along the length of the wand 6*a* in the channel defined by side walls 14, 15 and the flattened strip 13. At intervals along the slide rod 17 corresponding to the position of each light socket 5 extend upwardly enclosed loops 19 who's internal cam surfaces co-operate with a pivot pin 20 projecting from that side of each light socket 5 facing side wall 14 so that by reciprocating movement of the slide rod 17, the light socket 5 and attendant light bulb 4 can be raised or lowered to the position shown in, respectively, FIGS. 9 and 8.

The light bulbs 4 are normally maintained in the position shown in FIG. 9 by helical spring 21 which is secured between a stop member 22 and the end 23 of the wand 6*a*. A further stop member (not shown) at the other end of the slide rod 17 limits the amount of sliding movement available to slide rod 17 such that when the stop member 22 is pressed in the direction shown arrowed in FIG. 6 each bulb 4 assumes the position shown in FIG. 8 and when the stop member is released each bulb 4 assumes the position shown in FIG. 9.

Figure 10:
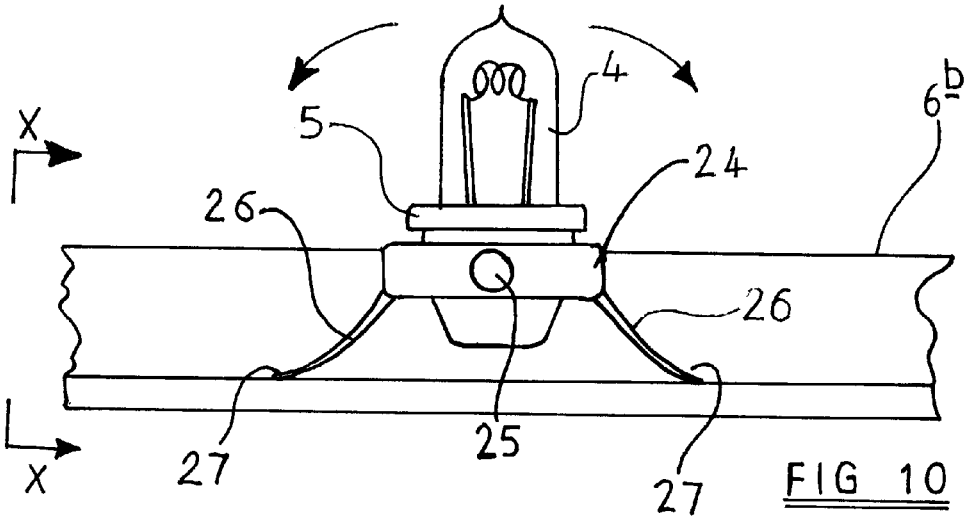
FIG. 10 is a part sectional view corresponding to that of FIG. 6 showing a still further alternative embodiment of the invention which allows the light socket and respective light bulb of each wand to be tilted when an obstacle such as a branch is encountered.
Figure 11:
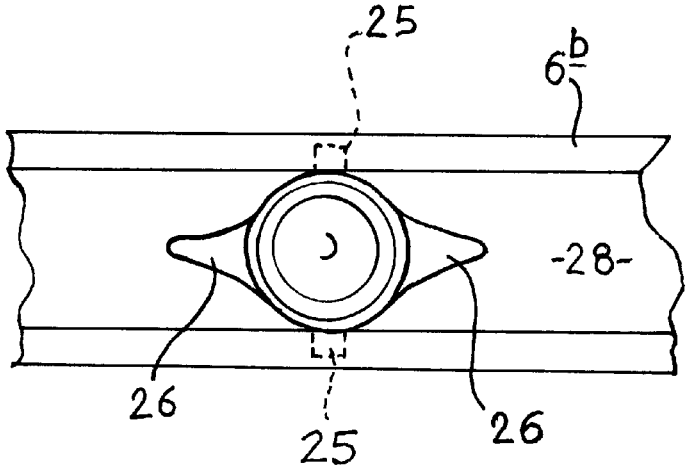
FIG. 11 is a plan view of the embodiment shown in FIG. 10.
Figure 12:
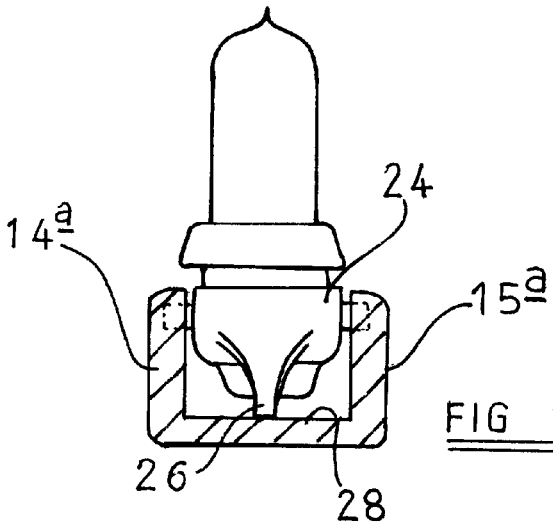
FIG. 12 is a part sectional end view along the line X—X of FIG. 10.

A further embodiment of the invention is shown in FIGS. 10–12 in which the light bulbs 4 and respective sockets 5 are spring-biased into an upright position relative to a wand 6*b* of channel section, only part of which is shown. In this instance the light socket 5 is wedged into a generally annular plastics socket cradle 24 of internal diameter corresponding to the external diameter of the light socket 5. Pivot pins 25 protrude from diametrically opposed positions on the outer surface of the socket cradle 24 and are received in complementary bores 26 formed at regular intervals along the opposing side walls 14*a*, 15*a* of the wand 6*b* so that each light socket 5 and respective light bulb 4 may be tilted about the axis of the pivot pins 25. As shown in FIG. 10, they are normally held in their upright position with respect to the wand 6*b* by means of a pair of bendable plastics leaves 26 integrally moulded with the socket cradle 24. These are disposed at an angle of approximately 45 degrees from the major plane of the socket cradle 24 and include feet 27 which engage the inner surface 28 of the wand 6*b* between the side walls 14*a* and 15*a*.

With this arrangement a light bulb 4 and its respective socket 5 is normally biased to remain in the position shown but when the wand 6*b* is being inserted or removed form a Christmas tree then if an obstacle such as a branch is encountered they will automatically tilt to one side or the other to permit access or removal, as the case may be. The hystersis in the leaves 26 thereafter permit them to assume their original shape, thereby tilting the light bulb 4 and socket 5 back to its original position as shown in the drawings. Although in this embodiment the spring means are provided in the form of the leaves 26 and respective feet 27, alternative spring means may be used such as a conventional metal helical spring mounted centrally beneath the socket cradle 24 and fixed centrally to the inner wall 28 of the wand 6*b,* with the socket cradle in this instance being connected to the otherwise free end of the spring.

It will be seen that the invention in its many forms provides a useful and novel method of illuminating the inside and external surfaces of a Christmas tree quickly and conveniently without the use of expensive or complicated accessories and at minimal risk to a person decorating the tree.

What I claim is:

1. An electrically operable decorative device for Christmas trees, the device comprising in combination a light string including a plurality of light sockets and associated light bulbs; and a plurality of elongated support rods for supporting selected groups of said light sockets at spaced intervals along the string, one said support rod for each group, each group of said light sockets and associated light bulbs being supported at spaced intervals along the length of each of said support rods, and one end of each support rod being connected to the string such that the other free end of each support rod is insertable from an outside perimeter of the Christmas tree into an interior of the Christmas tree, therefore to provide illumination therefor when the light string is wound around the outside perimeter of the tree.

2. A decorative device according to claim 1 in which at least one of the ends of each of the support rods includes an aperture permitting that end of the rod to be tied to a desired part of the Christmas tree.

3. A decorative device according to claim 1 or claim 2 further comprising means associated with each rod to permit light sockets associated therewith and their attendant light bulbs to be moved from a position where said light sockets and attendant light bulbs lie axially in line with the rod to an exposed position pointing away from the rod.

* * * * *